US005125884A

United States Patent [19]

Weber et al.

[11] Patent Number: 5,125,884

[45] Date of Patent: Jun. 30, 1992

[54] ADJUSTABLE BENCH EXERCISE APPARATUS

[76] Inventors: Raymond P. Weber, 890 W. 100 North, Provo, Utah 84601; Jesse G. Daybell, 715 N. 1600 West, Mapleton, Utah 84664; Gary L. Thornton; Lynn L. Thornton, both of P.O. Box 231, Pleasant Grove, Utah 84062

[21] Appl. No.: 646,180

[22] Filed: Jan. 28, 1991

[51] Int. Cl.[5] ..... A63B 21/00

[52] U.S. Cl. ..... 482/145; 482/142

[58] Field of Search ..... 272/144, 145, 93; 128/70-74

[56] References Cited

U.S. PATENT DOCUMENTS 4,205,665 6/1980 Burton .
4,634,119 1/1987 Pesthy .
4,638,793 1/1987 Therkorn .
4,672,697 6/1987 Schurch .
4,871,166 10/1989 Sterba et al. .
4,884,804 12/1989 Fenwick .

FOREIGN PATENT DOCUMENTS 8803791 6/1988 World Int. Prop. O. .

OTHER PUBLICATIONS

Atlantic Fitness Products Catalog; Nov. 1985, pp. 26-27 "Modular Exercise Bench."

*Primary Examiner*—Robert Bahr
*Assistant Examiner*—Linda C. M. Dvorak
*Attorney, Agent, or Firm*—K. S. Cornaby

[57] ABSTRACT

An adjustable bench exercising and rehabilitation apparatus has a bench pivotally attached near one end to a support structure resting on a horizontal surface. The bench has a hoisting device attached near its other end and secured to its support structure for raising and lowering the bench about its pivot point. The hoisting device is actuated by a control panel accessible to the user while reclining on the bench. At the upper end of the bench, the bench has an adjustable ankle retaining bolster to hold the user on the bench as it inclines. The upper end of the bench has an adjustable knee support device which can support its user's knees at a 135° or a 90° angle while on the bench.

9 Claims, 2 Drawing Sheets

ADJUSTABLE BENCH EXERCISE APPARATUS

BACKGROUND OF THE INVENTION

Figure 1:
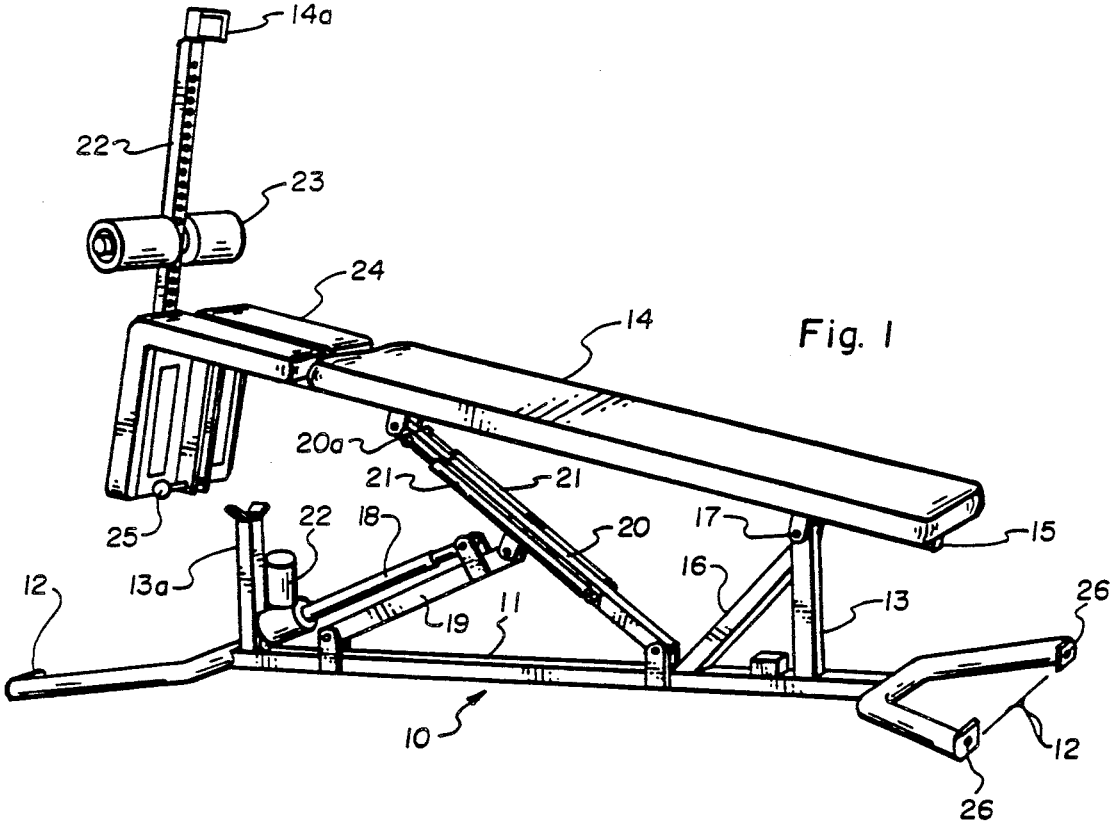

This invention relates to an adjustable bench exercise apparatus for bodybuilding and rehabilitation purposes.

The prior art is replete with bodybuilding devices for use by both amateur and professional bodybuilders to strengthen and develop various muscles and parts of the body. Among the most common area bench devices used to develop abdominal muscles. Attempts have been made to combine the advantages of abdominal bench devices with other features to provide multipurpose bench apparatus to develop other body areas. Such as leg muscles and chest muscles. Such prior art devices have experienced very limited use and acceptance by the bodybuilding community for a number of reasons. For example, prior art benches require a second person to assist in adjusting the designed angle for use by an individual. Most prior art benches also are limited to one or two additional add-on features which, while providing in some instances for additional exercises, do not provide for most of the body building or rehabilitative needs of the user on a single device.

Accordingly, it is an objective of this invention to provide an exercise apparatus for use by bodybuilders and the like to exercise and develop most of the important muscle areas of the body.

It is further objective to provide an exercise device to enable rehabilitative exercises to be employed to rehabilitate injured or handicapped persons, such as elongation of the spine and exercise for paraplegics or leg amputees.

SUMMARY OF THE INVENTION

The objectives stated above and others not mentioned are achieved through an exercise device having a sectioned support bench having power-assisted adjustment means for adjusting the incline of the bench relative to the horizontal. The support bench is further provided with including control means available to the user while reclining on the bench. The bench is also provided vertically with foot and ankle-securing means at one end thereof for securing the feet and ankles of user. The bench also has a movable end section formed at an angle to surface of the bench, and which is adopted to a positioned needs the knees of the user at either a 135° angle or a 90° to the surface of the bench.

THE DRAWING

Figure 2:
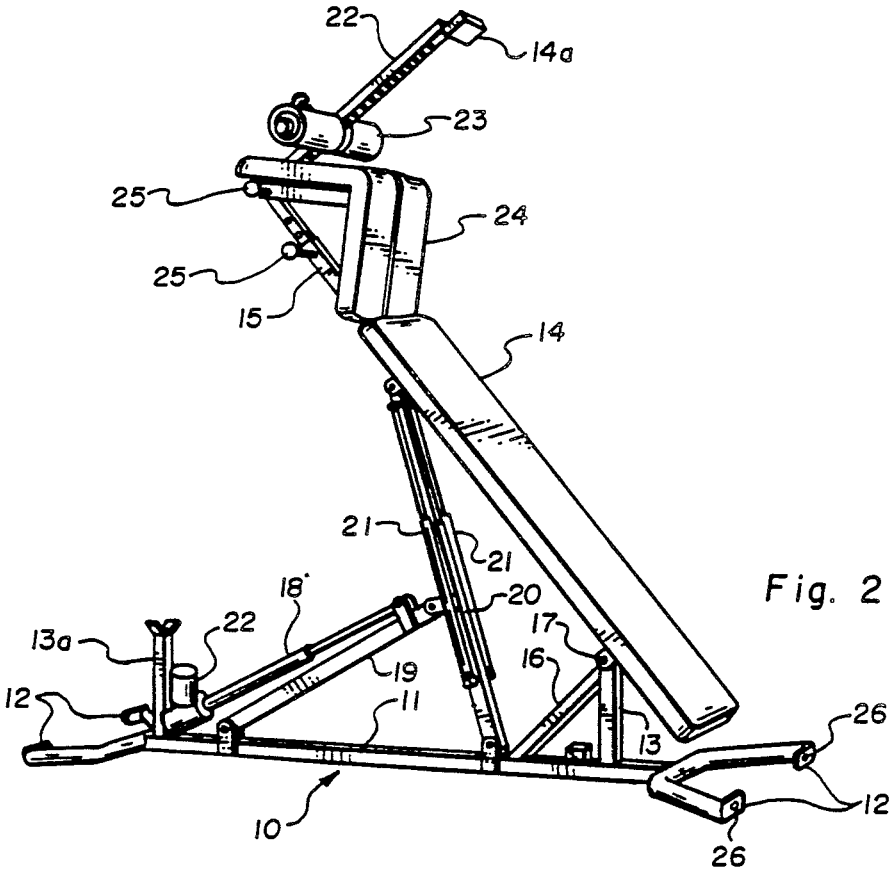
Figure 3:
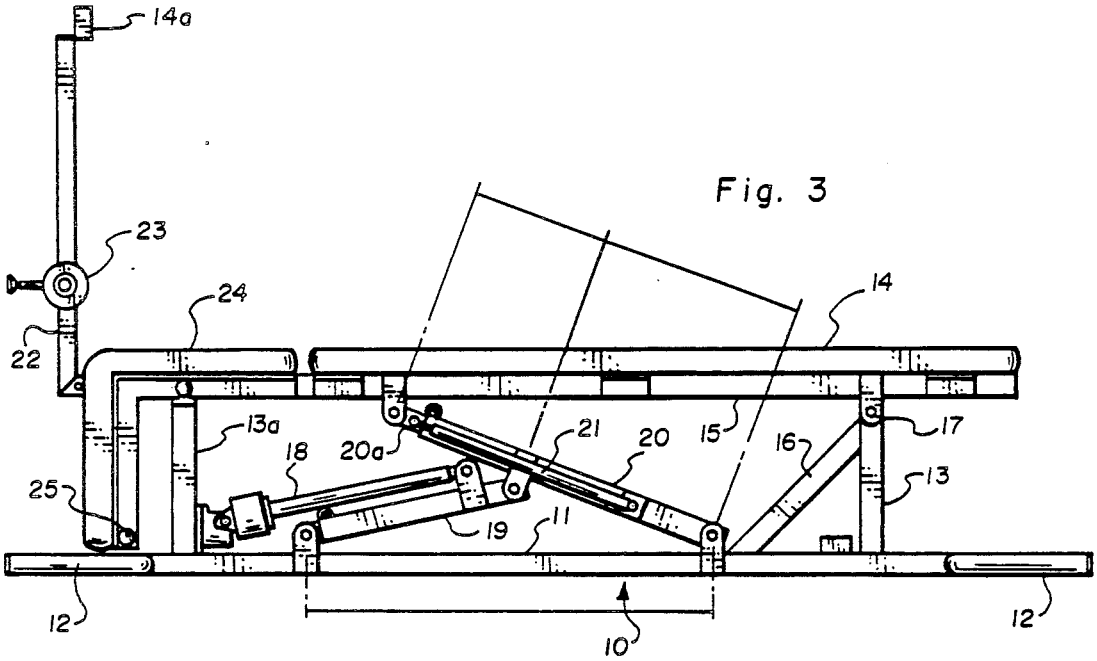
Figure 4:
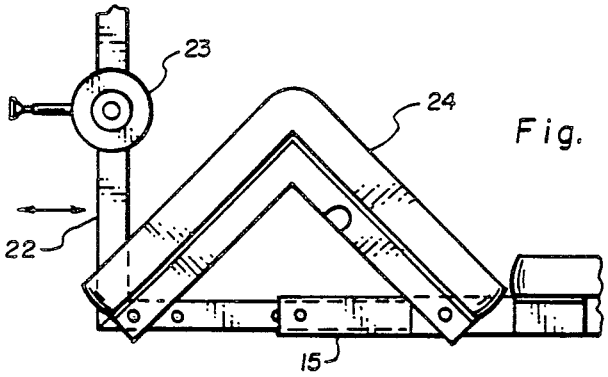
Figure 5:
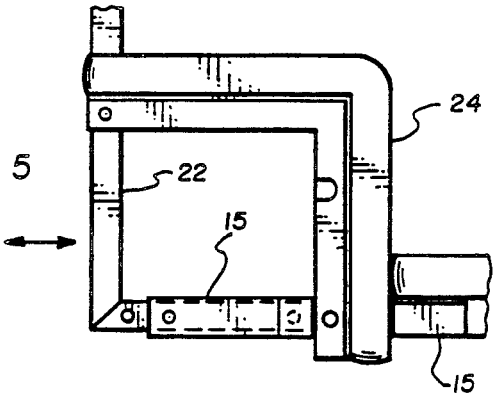

A performed embodiment of the invention is illustrated in the accompanying drawing, in which:

FIG. 1 is a side prospective view of the exercise opposition of the invention showing the bench in a partially inclined position;

FIG. 2, a side prospective view of the exercise apparatus shown in FIG. 1, with the bench in a full inclined position and the knee support section of the bench in a 135° angle;

FIG. 3, a side elevational view of the exercise apparatus showing the bench in a full reclined position;

FIG. 4, a side sectional view of the knee support section in the 135° angle position relative to the bench surface; and FIG. 5, a side sectional view of the knee support section in the 90° angle position relative to the bench surface.

As illustrated in FIGS. 1, 2 and 3 of the accompanying drawing, a preferred embodiment of the invention has a floor support structure 10 adapted to rest on the horizontal surface of a floor (not shown). Support structure 10 has an elongate horizontal metal bar 11 with a pair of outstanding angled support bars 12 disposed at either end of horizontal bar 11 to provide lateral stability. Horizontal bar 11 and angled support bars 12 are adapted to set in a stable position on a horizontal surface, such as a floor.

Horizontal support bar 11 has a pair of upright support posts 13, **13*a* disposed respectively near either end of horizontal support bar 11. Upright support posts 13, 13*a* are adapted to provide vertical support at either end of a bench 14. Bench 14 is vertically rotably attached near one end thereof to the upper end of vertical support post 13, and is adapted to rest when in the fully reclining position upon vertical support post 13*a***, as shown in FIG. 3.

Bench 14 preferably has an elongate metal support tube 15 extending the length thereof for rigidity and support; and in FIG. 3, the square support tube 15 is shown resting in place on vertical support post **13*a*. Bench 14 may be padded or the like for the comfort of the user. Support post 13 in the illustrated embodiment has an upwardly angled support post 16 attached between horizontal bar 11 and support post 13** for additional strength and rigidity.

The apparatus of the invention has an automatic hoisting system for moving bench 14 upwardly and downwardly about pivot point 17. The preferred hoisting system as shown in the attached drawings has an elongate worm gear 18 pivotally attached at one end thereof to support post **13*a*. At its other end the fear 18 is pivotally attached to a static alignment tube 19 for protecting the worm gear from stress. Static alignment tube 19 is pivotally attached to an elongate hoisting bar 20, which is pivotally attached at either end respectively to horizontal support bar 11 and bench square support tube 15**.

As worm gear 18 is actuated, it extends static alignment tube 19 which in turn extends elongate hoisting bar 20 upwardly, thereby moving bench 14 from the horizontal, as shown in FIG. 3, through a moderate angle shown in FIG. 1, to a full upward position of about 55°, shown in FIG. 2. The angle of recline can be shown on a digital indicator **14*a*. Elongate hoisting bar 20 is provided with a pair of safety return absorbers 21 pivotally attached at both ends thereof to either side of bar 20 and its inner extension rod 20*a*. The safety return absorbers 21 are provided to alleviate gravity pull on the worm gear 18. Worm gear 18 is actuated by an electric motor actuating means 22. Other actuating means can also be employed, such as hydraulic, pneumatic, or the like. The control means for the actuator 22 can be controlled by a hand-held control mechanism to permit the user to rise or lower the bench 14** while positioned on the bench.

A vertical ankle retaining bar 22 extends upwardly from the upper end of bench support tube 15, and is removeably secured at one end thereof to the end of tube 15 at 90° angle, as shown in detail in FIGS. 4 and 5. The user's ankles are retained in position with respect to bar 22 by means of a cylindrical padded roll 23, removeably secured to one of a series of apertures positioned along the length of bar 22. In this way, the padded roll 23 can be adjusted upwardly or downwardly along bar 15 to lock the user's ankles into a secure position while the user reclines on bench 14 with his head at the opposite, downward end of bench 14.

The apparatus of the invention has a knee support section 24 removeably attached to the upper end of bench support tube 15. As shown in FIGS. 3, 4 and 5, knee support section 24 can be positioned in at least 3 positions for use in working with the upper, mid-range and lower abdominal muscles or to elongate the spine in therapeutic use without direct pressure on the ankle and knee.

FIG. 3 illustrates the knee section 24 in its down position functioning as an extension of bench 14. FIG. 4 shows the knee section 24 in its 135° angle position; and FIG. 5 shows the knee section 24 in its 90° angle position. In each position, the knee section is secured in place either on bench support tube 15 or ankle bar 22 by means of snap lock adjustment pins 25, shown in FIGS. 1, 2 and 3.

As previously noted, the apparatus of the invention can be employed for rehabilitative purposes as well as bodybuilding. Also a series of such devices can be attached together through the use of linkage tabs 26 on the angled support braces 12. The apparatus is preferably constructed of a stable metal, such as stainless steel, space-age materials or the like. It is important, of course, that the materials be resistant to heat and stress. The apparatus can also be employed with dumbbells to build the chest and shoulders.

While this invention has been described with reference to preferred embodiments illustrated in the accompanying drawing and described in the attached claims, it is intended that substantial equivalents apparent to those skilled in the art are included within the scope of this invention.

We claim:

1. An adjustable bench exercising apparatus comprising in combination:

a support structure adapted to rest upon a horizontal surface;

elongate bench means pivotally attached at one end thereof to said support structure;

power activated elevating means attached to said support structure for elevating said bench means about the point of the pivotal attachment of said bench means with said support structure;

adjustable ankle retaining means attached to the non-pivotal end of said bench means; and an adjustable right-angled removable extension for supporting a bench user's knees, said extension attached to the non-pivotal end of the bench means, and wherein the knee support right-angled extension forms a 135 degree angle between the upper surface of the bench means and the upper surface of the right-angled extension.

2. An exercise apparatus as set forth in claim 1, including control means for said power activated elevating means which is accessible to a user while on said bench means.

3. An exercise apparatus as set forth in claim 1, wherein said power activated elevating means is a worm-gear driven hoist powered by an electrical motor.

4. An exercise apparatus as set forth in claim 1, wherein the power activated elevating means is a hydraulic device.

5. An exercise apparatus as set forth in claim 1, wherein said power elevating means is a pneumatic device.

6. An exercise apparatus as set forth in claim 1, wherein the knee support right-angled extension forms a 90 degree angle between the upper surface of the bench means and the upper surface of the right-angled extension.

7. An exercise apparatus as set forth in claim 1, wherein said ankle retaining means has an upwardly extending rod with a padded bolster adjustably mounted on the rod for clamping the user's ankles between the bolster and the bench.

8. An exercise apparatus as set forth in claim 1, including device for indicating the vertical angle of the bench means.

9. An exercise apparatus as set forth in claim 1, including means for attaching multiple exercise apparatuses together for use at the same time.

* * * * *